US005363523A

United States Patent [19]

Blackburn

[11] Patent Number: 5,363,523

[45] Date of Patent: Nov. 15, 1994

[54] SURGICAL PILLOW WITH REMOVABLE WEIGHT

[76] Inventor: Linda M. Blackburn, 5181 Daval Dr., Swartz Creek, Mich. 48473

[21] Appl. No.: 209,705

[22] Filed: Mar. 14, 1994

[51] Int. Cl.[5] ..... A61G 7/06

[52] U.S. Cl. ..... 5/630; 5/639

[58] Field of Search ..... 5/621, 630, 636, 639, 5/643, 645

[56] References Cited

U.S. PATENT DOCUMENTS

| | | | |
|---|---|---|---|
| 3,226,737 | 1/1966 | Rote | 5/417 |
| 3,372,696 | 3/1968 | Rudie | 128/132 |
| 4,091,481 | 5/1978 | Redman | 5/639 |
| 4,227,270 | 10/1980 | Rivera | 5/436 |
| 4,309,784 | 1/1982 | Cohen | 5/639 |
| 4,345,347 | 8/1982 | Kantor | 5/441 |
| 4,634,618 | 1/1987 | Greer et al. | 5/417 X |
| 4,683,601 | 8/1987 | Lagin | 5/431 |
| 4,688,286 | 8/1987 | Miker, Jr. | 5/490 |
| 4,768,245 | 9/1988 | Dutton | 5/434 |
| 4,829,613 | 5/1989 | Yon | 5/431 |
| 5,168,590 | 12/1992 | O'Sullivan | 5/639 X |

*Primary Examiner*—Michael F. Trettel
*Attorney, Agent, or Firm*—Krass & Young

[57] ABSTRACT

A post-operative pillow includes a weight and means to removably secure the weight to the pillow, the function of the weight being to assist in the application of pressure to a localized area of the patient's body, for example to the chest area following open-heart surgery. In the preferred embodiment, the means to removably secure the weight to the pad includes a pocket formed on an outer portion of the pillow, with the weight being frictionally retained within the pocket. The weight is preferably in the form of an elongated washable pouch filled with a heavy material such as lead shot.

11 Claims, 1 Drawing Sheet

SURGICAL PILLOW WITH REMOVABLE WEIGHT

FIELD OF THE INVENTION

The present invention relates generally to medical cushions and, in particular, to a post-operative chest pad including a weight to assist in the application of pressure to the sternum, for example following open-heart surgery.

BACKGROUND OF THE INVENTION

Patients having undergone open-heart surgery are frequently prone to the accumulation of fluid in the lungs, and require a post-operative regimen of induced coughing so as to expectorate this fluid. Hospitals typically provide the patient with a protective pad or pillow to be held against the chest during this process, to minimize discomfort and to protect the sternum from post-operative separation. U.S. Pat. No. 4,829,613 teaches such a pad for post-operative recovery, this particular invention including a diagram of physical features in the area of the human heart on its outer surface.

However, to minimize the discomfort to the sternum, it is preferable that the device being used by the patient have substantially more mass than a simple pillow, regardless of its overall shape. In prior-art designs, the patient is relied upon to hold the pillow against the chest area, and since most such patients are weakened from the surgery itself, any assistance in applying this pressure would be greatly appreciated by such patients.

SUMMARY OF THE INVENTION

The present invention improves upon prior-art medical-type pillows through the addition of a weight and means to affix the weight to the pillow, the pillow/-weight combination having a greater weight to volume ratio than the pillow itself, thereby assisting in the application of pressure to the chest area through gravitational pull. In the preferred embodiment, the means to affix the weight to the pad includes a pocket formed on an outer portion of the pillow, with the weight being frictionally retained within the pocket. A gathering may also be included at the entrance of the pocket to help retain the weight once inserted. The weight is preferably in the form of an elongated bar-shaped element intended for displacement above and parallel to the patient's sternum once affixed to the pillow. To ease maintenance, weight may be contained within a washable pouch, for example, as lead shot within a soft vinyl pouch. The outer casing of the pillow itself may be preferably removable and washable apart from any stuffing material used, and the pillow may further be heart-shaped with the patient's neck positioned between the upper rounded portions of the heart to better position the pillow and the weight over the pertinent areas of the patient's body.

DETAILED DESCRIPTION

The present invention improves upon pillows or pads used to apply pressure to the sternum of a patient having undergone chest-related surgery in order to ease the patient's discomfort and protect affected areas. While the concept of providing such a pillow, including a heart-shaped pillow or pad, is well known, the present invention improves upon this existing art through the introduction of a weight and means to removably secure the weight to the outside of the pillow, the gravitational pull on the weight causing the weight to volume ratio of pillow/weight combination to be markedly increased, thereby assisting in the application of pressure to the chest area, particularly those areas directly related to the sternum.

Figure 1:
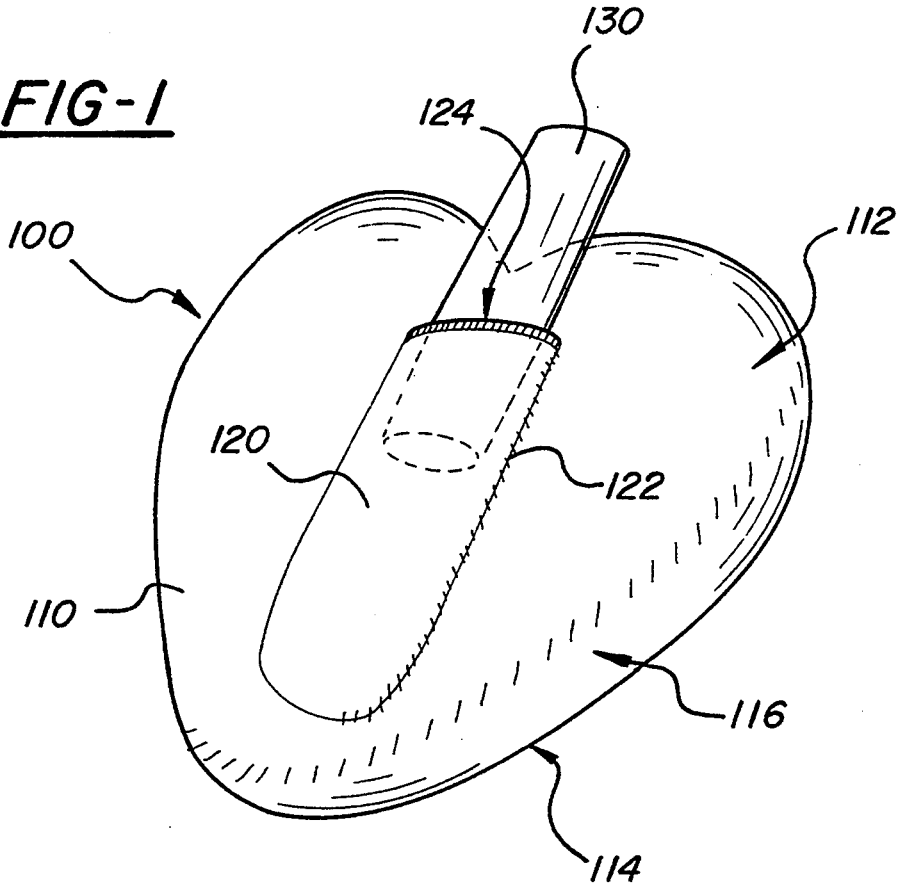
FIG. 1 is a oblique drawing of a pillow including a elongated weight and a pocket to receive the weight in accordance with the present invention.

FIG. 1 shows a preferred construction of a weighted pillow 100 formed in accordance with the present invention. An outer casing 110 includes a top surface 112, a bottom surface 114, and an edge 116, the height of the edge 116 being smaller than dimensions associated with the top and bottom surfaces, resulting in a pad-like shape overall. Though shown to be heart-shaped, it should be understood that the outer casing 110 of the pillow may take many forms in accordance with this invention, including round, square, rectangular and so forth, the central improvement the addition of a weight and weight-receiving means which will now be described.

The weight 130 depicted in FIG. 1 is preferably in the form of a elongated bar shape, and, in the preferred embodiment, the means to removably secure this weight to the pillow comprises a conformal pocket 120 attached to surface 112, for example, through stitching 122, though other means such as heat-related bonding, and so forth, may alternatively be used. Primarily, with the shape of the pocket 120 and that of the weight 130 being substantially similar, weight 130 is held in place by the friction of the pocket, though a further aid to retention may be afforded by a constricted upper end 124, including the use of an elastic gathering section at this upper end 124 which constricts once weight 130 is received by the pocket 120. To ease maintenance problems common in hospital situations, the outer casing 110 of the overall pillow is washable, and, if stuffed with a separate material, this material may be removed in order to wash the outer casing 110 with pocket 120 being permanently attached. Likewise, in the preferred embodiment weight 130 also includes a washable outer surface. It is also preferable that weight be somewhat flexible so as to ease discomfort, in which case the use of a soft pouch filled with a heavy material such as lead shot affords a convenient construction.

Figure 2:
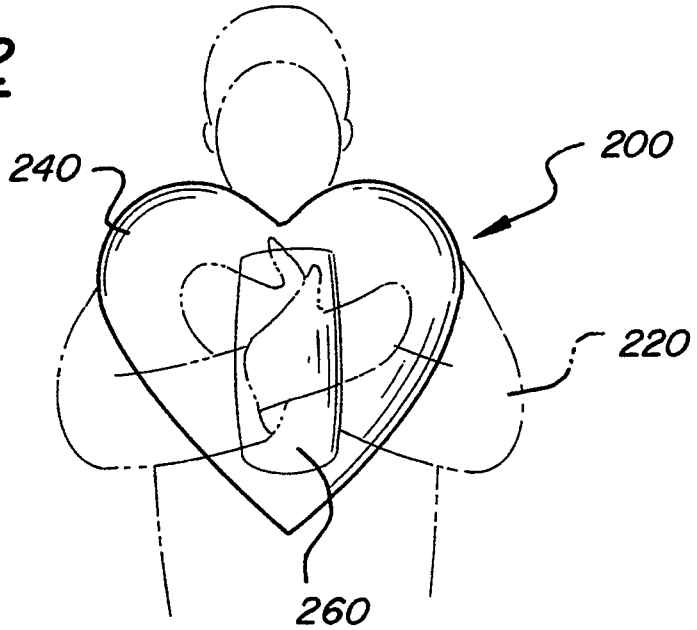
FIG. 2 is an illustration showing how the pillow of FIG. 1 is preferably held in place by the patient.

Now making reference to FIG. 2, there is shown at 200 a patient 220, shown with broken lines, making use of the pillow 240 previously described with reference to FIG. 1. In the case of a heart-shaped construction, the pillow would be held as shown, with the patient's chin being supported on either side by the two rounded upper portions of the heart, the lower somewhat pointed portion of the heart being directed toward the patient's waist. In such a configuration, the pocket with weight contained therein at 260 is ideally situated directly above the patient's sternum, such that with the hands folded as shown, the pressure to this particular area of the chest is greatly increased relative to prior-art teachings.

Having thus described my invention, I claim:

1. A post-operative pillow of the type used to apply pressure to the chest area of a patient having undergone chest-related surgery, comprising:

a pad having a volume and a chest-contacting surface;

a weight; and means to removably secure the weight to the pad, the pad/weight combination having a greater weight to volume ratio than the pad itself, thereby assisting in the application of pressure to the chest area through gravitational pull.

2. The pillow of claim 1, the means to removably secure the weight to the pad including a pocket formed on an outer portion of the pad to receive and retain the weight.

3. The pillow of claim 2, the weight being frictionally retained within the pocket.

4. The pillow of claim 2, further including a gathering at the entrance of the pocket to retain the weight once inserted.

5. The pillow of claim 1, the weight being in the form of an elongated bar-shaped element intended for displacement above and in spaced-apart parallel relationship to the patient's sternum.

6. The pillow of claim 5, the bar-shaped element comprising a washable pouch filled with a heavy material.

7. The pillow of claim 6, the heavy material comprising lead shot.

8. The pillow of claim 1, said pad being heart shaped, the point of the heart being oriented toward the waist of the patient, enabling the two upper rounded portions of the heart to at least partially cover the patient's shoulders with the patient's neck oriented between the two upper rounded portions.

9. A protective pad of the type used by a patient during post-operative recovery from open-heart surgery, comprising:

a weight in the form of an elongated mat;

a stuffed, washable outer shell including a bottom surface to contact a patient's chest area, and a top surface having a pocket configured to receive and retain the mat.

10. In a pillow of the type used to apply pressure to the chest of a patient having undergone surgery requiring a splitting of the sternum, the improvement comprising:

an externally accessible pocket formed on a surface of the pillow; and a weight to be received and retained by the pocket, the application of pressure being increased through gravitational pull on the weight.

11. The pillow of claim 10, the weight being in the form of a washable, elongated pouch filled with a heavy material.

* * * * *